US011812817B2

(12) United States Patent
Bookoff

(10) Patent No.: US 11,812,817 B2
(45) Date of Patent: Nov. 14, 2023

(54) KNITTED FOOT GARMENT AND METHOD FOR TREATING A KNITTED FOOT GARMENT

(71) Applicant: Arnold Bookoff, Owings Mills, MD (US)

(72) Inventor: Arnold Bookoff, Owings Mills, MD (US)

(73) Assignee: Arnold Bookoff, Owings Mills, MD (US)

( * ) Notice: Subject to any disclaimer, the term of this patent is extended or adjusted under 35 U.S.C. 154(b) by 0 days.

(21) Appl. No.: 17/823,982

(22) Filed: Sep. 1, 2022

(65) Prior Publication Data

US 2023/0000198 A1 Jan. 5, 2023

Related U.S. Application Data

(63) Continuation-in-part of application No. 17/069,296, filed on Oct. 13, 2020, now abandoned.

(51) Int. Cl.
*A43B 1/04* (2022.01)
*A43B 1/028* (2022.01)

(52) U.S. Cl.
CPC ..... *A43B 1/04* (2013.01); *A43B 1/028* (2022.01)

(58) Field of Classification Search
None
See application file for complete search history.

(56) References Cited

U.S. PATENT DOCUMENTS 6,028,017 A * 2/2000 Curtin ..... B32B 5/245 428/137
2013/0025036 A1* 1/2013 Turner ..... A42B 3/125 2/455
2014/0230131 A1* 8/2014 Alston ..... A41B 11/007 2/239

* cited by examiner

*Primary Examiner* — Christopher T Schatz
(74) *Attorney, Agent, or Firm* — LAUBSCHER & LAUBSCHER, P.C.

(57) ABSTRACT

A knitted foot garment including an upper, heel, toe, and sole knitted fabric portions integrally woven together to define a chamber. A plurality of encapsulated polymer pads are attached to and protrude from an outer surface of at least one of a heel, toe, ball and arch portion of the garment. The polymer pads contain gas infused gel to provide increased cushioning to the sole of the foot garment. A method for treating a knitted foot garment that provides added cushion to the knitted material of the sock includes the steps of heating a liquid polymer gel mixture, forcing gas into the mixture, agitating the mixture to create a gas infused mixture, injecting the gas infused mixture into a polymer template including a plurality of pads, attaching the polymer pads to the outer sole of a knitted foot garment, and cooling the gas infused polymer mixture.

9 Claims, 5 Drawing Sheets

KNITTED FOOT GARMENT AND METHOD FOR TREATING A KNITTED FOOT GARMENT

This application claims the benefit of U.S. provisional patent application No. 62/913,839 filed Oct. 11, 2019 and is a continuation-in-part of U.S. patent application Ser. No. 17/069,296 filed Oct. 13, 2020. The entire content of these applications is incorporated herein by reference.

BACKGROUND OF THE DISCLOSURE

The present disclosure relates to foot garments and more specifically to knitted foot garments with increased cushioning.

Knitted foot garments, also referred to herein as socks, are used to protect and/or warm an individual's foot. They are made from a range of fibrous material, whether naturally occurring, such as cotton or wool, or synthetic, such as acrylic or polyester. Further, socks are made for a number of different reasons. Some are formed of thick material for providing extra warmth in cold weather or for providing extra cushioning for extensive walking and/or standing. Some are specifically manufactured for athletic undertakings, often including materials that have sweat and/or odor reducing qualities. Socks can be long and cover a person's leg, or be short, covering only the portion of the foot that will be inserted into a shoe.

Of the many potential features of a sock, providing comfort to a user is one of the most important. Attempts to provide more comfort from a sock typically include providing extra material on the sole of a sock or stitched padding in heavily used regions, such as the heal or ball of one's foot. Often times, however, these methods do not provide the comfort one needs, and thus other measures must be taken to provide sufficient comfort. One such measure may be in the form of extra cushioning within a shoe, whether incorporated in the manufacturing process or with after-market padded insoles. The drawback with this measure is that the cushioning within a shoe is only provided while wearing a shoe.

Therefore, there is a need for knitted foot garments, such as socks, that provide greater comfort to the sole of a user than those currently offered.

SUMMARY OF THE DISCLOSURE

Accordingly, it is an object of the present disclosure to provide a knitted foot garment including an upper, heel, toe, and sole knitted fabric portions integrally woven together to define a chamber. A plurality of encapsulated polymer pads are attached to and protrude from an outer surface of at least one of a heel, toe, ball and arch portion of the garment. The polymer pads contain gas infused gel to provide increased cushioning to the sole of the foot garment.

It is a further object of the present disclosure to provide a method for treating a knitted foot garment that provides added cushion to the knitted material of the sock, which includes the steps of heating a liquid polymer gel mixture, forcing gas into the mixture, agitating the mixture to create a gas infused mixture, injecting the gas infused mixture into a polymer template including a plurality of pads, attaching the polymer pads to the outer sole of a knitted foot garment, and cooling the gas infused polymer mixture.

BRIEF DESCRIPTION OF THE FIGURES

Other objects and advantages of the invention will become apparent from a study of the following description when viewed in the light of the accompanying drawing, in which.

DETAILED DESCRIPTION

Figure 1:
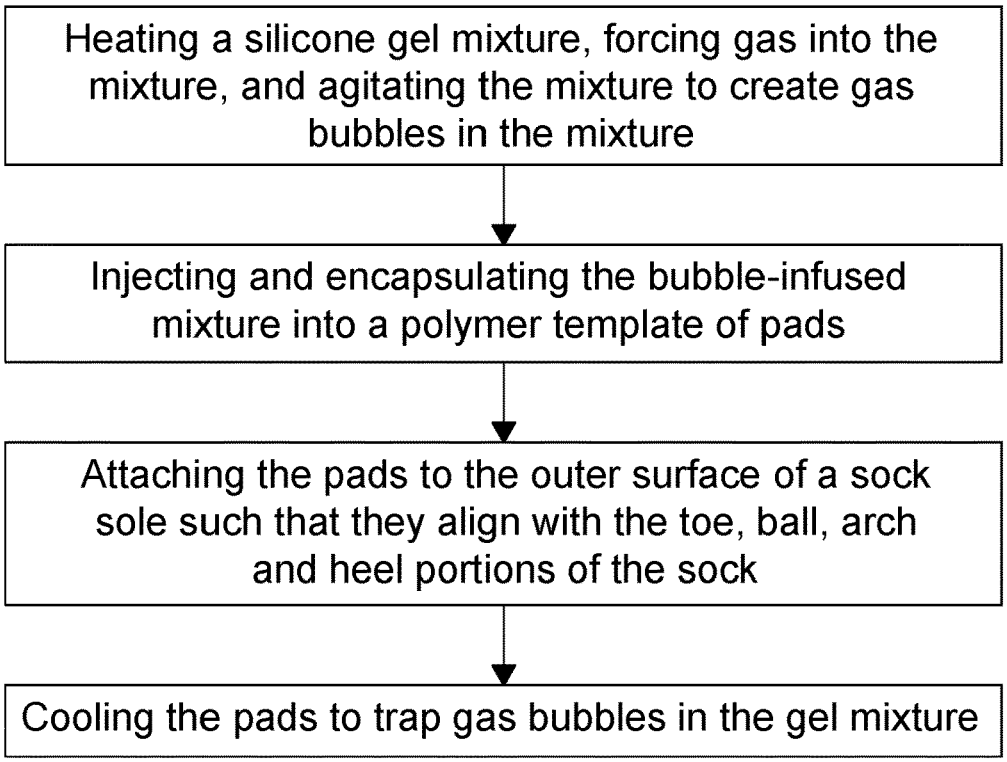
FIG. 1 is a flow chart showing steps for treating a knitted foot garment according to the present disclosure.
Figure 2:
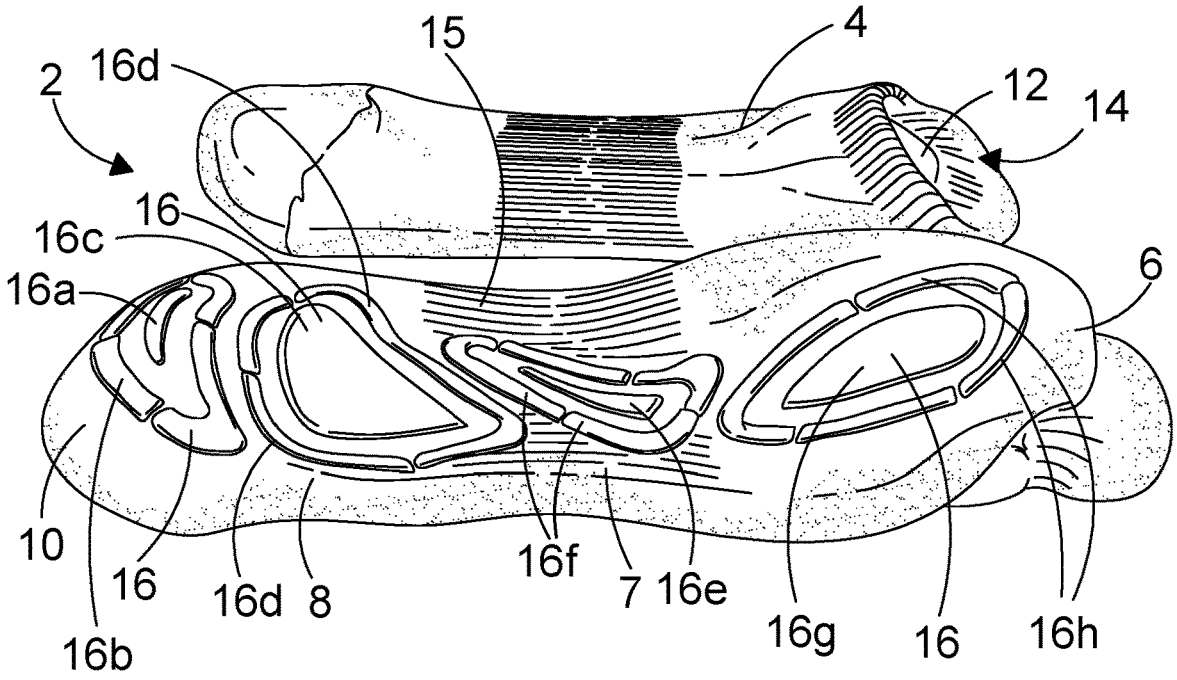
FIG. 2 is a perspective view of knitted foot garments according to the present disclosure.

Referring first to FIG. 1, a flow chart shows a method for treating a knitted foot garment. The method includes heating a liquid polymer mixture, such as a silicone gel, forcing gas into the mixture, and agitating the mixture to create a bubble infused mixture. Once the bubble infused mixture is created, it is injected into a polymer template, which is attached to the outer sole of a knitted foot garment. The mixture is cooled to trap the bubbles in each of the encapsulated pads of the template. The gas infused bubbles results in cushioning on the bottom of a foot garment, which provides more cushioning than with standard polymer templates that do not include the gas bubbles.

Referring now to FIGS. 2-6, an embodiment of a knitted foot garment 2 is shown. It includes upper 4, heel 6, arch 7, ball 8, and toe 10 portions, all integrally woven together to define an inner chamber 12. The upper contains an opening 14 through which a foot is inserted. The heel, arch, ball and toe portions together form the sole 15. There are a plurality of encapsulated convex polymer pads 16 attached to and protruding from the outer surface of the heel, arch, ball and toe portions of the garment. The pads are made of a silicone gel mixture and are configured to correspond with the contours of the heel, arch, ball, and toe portions of a foot.

A first set of pads 16*a*, 16*b* are attached to the toe portion. These pads include a first, elongated inner pad 16*a* and a set of a plurality of elongated outer pads 16*b* arranged around the inner pad 16*a*, generally outlining the inner pad. A second set of pads 16*c*, 16*d* are also attached to the ball portion. These pads include a first, inner pad 16*c* having a generally kidney-shaped configuration and a plurality of elongated outer pads 16*d* arranged around the inner pad 16*c*, generally outlining the inner pad. A third set of pads 16*e*, 16*f* are attached to the arch portion. These pads include a first, inner pad 16*e* having a generally crescent-shaped configuration and a second set of a plurality of elongated outer pads 16*f* arranged around the inner pad 16*e* generally outlining the inner pad. A fourth set of pads 16*g*, 16*h* are attached to the heel portion. These pads include a first, inner pad 16*g* having a generally oval-shaped configuration and a second set of a plurality of elongated outer pads 16*h* arranged around the inner pad 16*g* generally outlining the inner pad.

Figure 9:
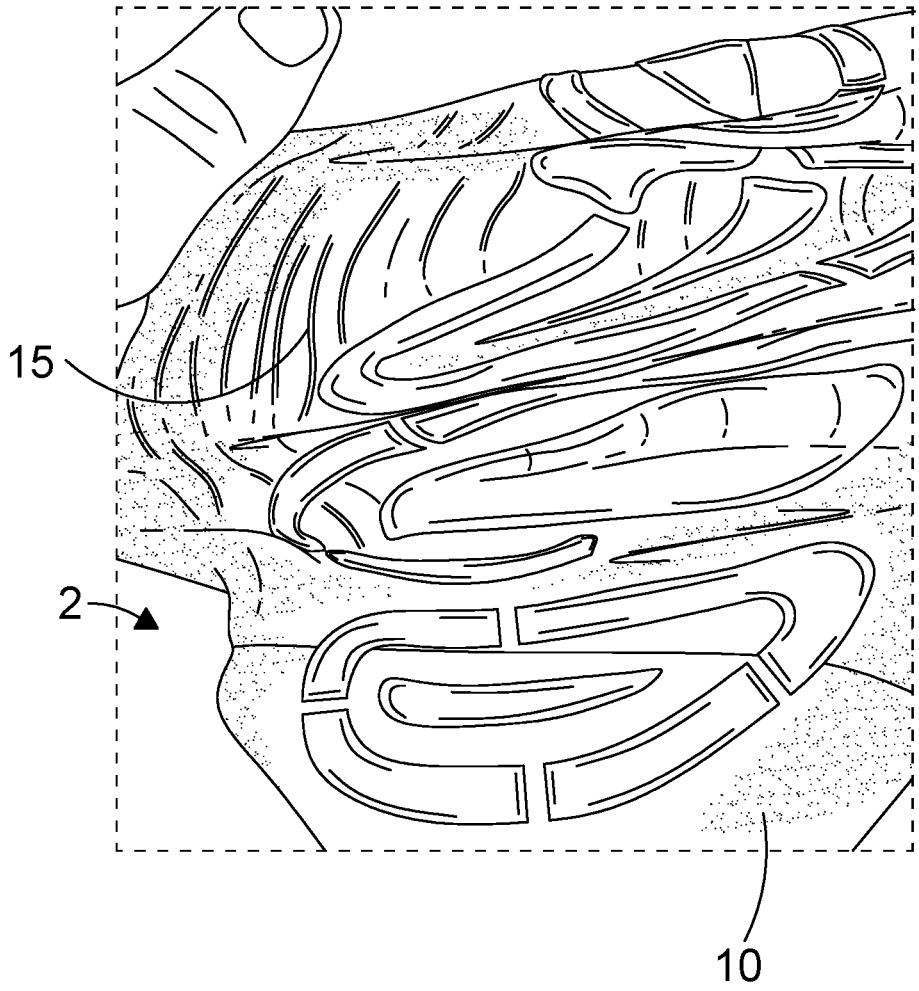
FIG. 9 is a front view of a portion of the knitted foot garment of FIGS. 5-8.

The pads 16 have a high degree of flex and stretch, generally flexing and stretching to the degree that a standard knitted foot garment (i.e. sock) is capable of flexing and stretching. This is due to the pads including a silicone, gas infused gel. The material of the pads thus provides additional cushion to the knitted foot garment, but also allows the garment to flex and stretch to the degree a knitted foot garment would if it did not include the pads. This general flex and stretch are shown in FIGS. 6-9 with the multiple ways in which the sock is folded about itself (FIGS. 6-8) and the way in which the pads stretch along with the knitted foot garment (FIG. 9). The flex and stretch, in combination with the significant portion of the outer sole 15 that does not include pads, results in a sock with pads that can flex and stretch to the same extent that a knitted sock without pads would flex and stretch.

By attaching a plurality of pads 16 to portions of the knitted foot garment sole 15, and specifically along outlines related to typical pressure locations of an individual's foot, the treated foot garment provides much-needed support in areas where foot pressure is often placed. However, again, the garment is not overly encumbered by the pads as are some products that include pads that cover all or the vast majority of the sole of a knitted foot garment. Attaching these gel pads 16 such that they replicate the contours of portions of a foot (i.e. toe, ball, arch and heel) ensures that a significant portion of the sole 15 does not include the pads. Preferably, to provide a high level of flex and stretch, the knitted foot garment includes approximately 75% nylon, 22% polyester, and 3% spandex.

To create and attach the pads 16 to the sole 15, a template with the above noted numerous pads is created. The pads include an inner chamber in which the silicone gel can be injected. As noted above, the silicone mixture is heated, gas is forced into the mixture, and the mixture is agitated to create a bubble infused gel mixture which is then injected into the pads of the template. Ultimately, the pads 16 are attached to the knitted foot garment sole 15. This may take place prior to injecting the pads with the gel, or the pads may be attached and then injected with the gel. Once the gel is injected into the pads, the mixture is cooled to finalize the process encapsulation of the gas infused gel pads.

Figure 3:
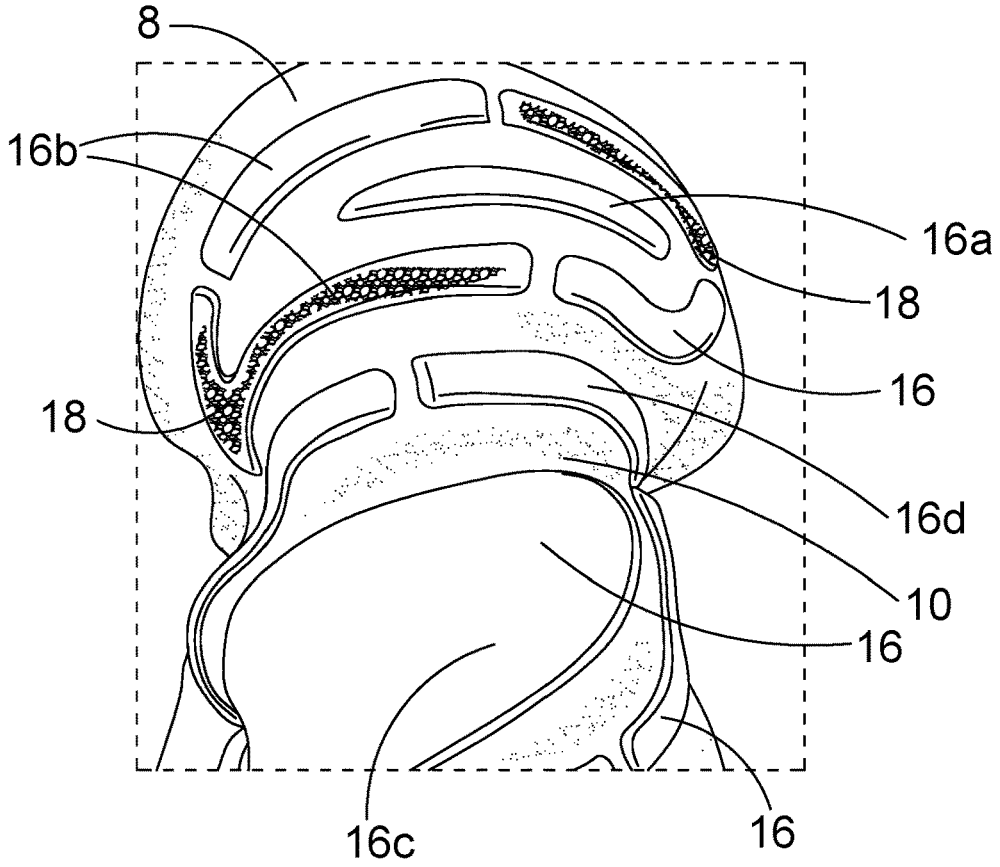
FIG. 3 is a front view of the sole of the embodiment in FIGS. 1 and 2.
Figure 4:
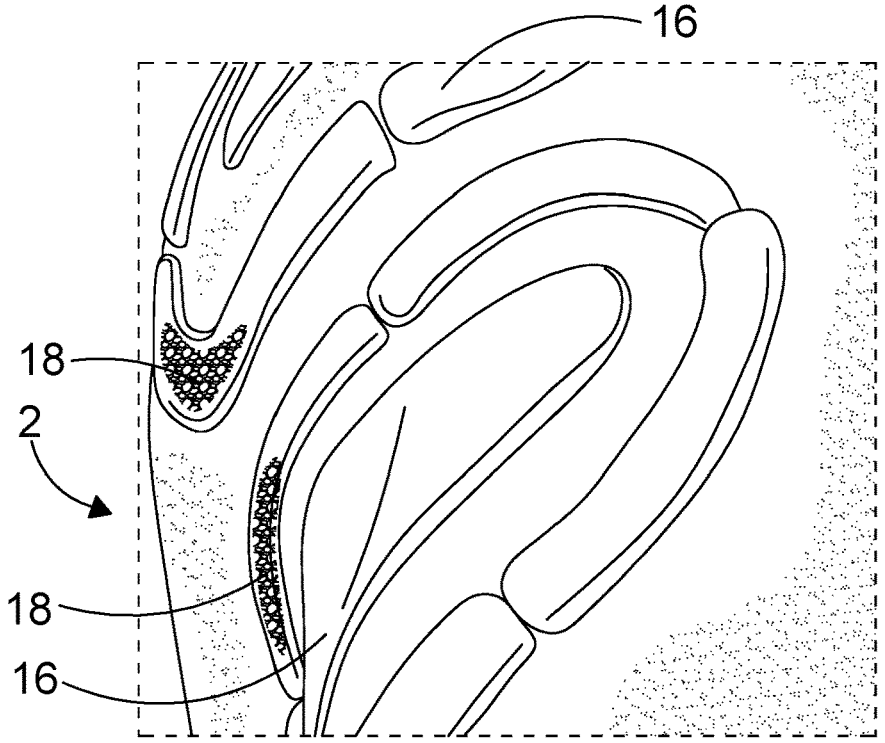
FIG. 4 is a perspective view of a portion of the sole in FIGS. 1 and 2.
Figure 5:
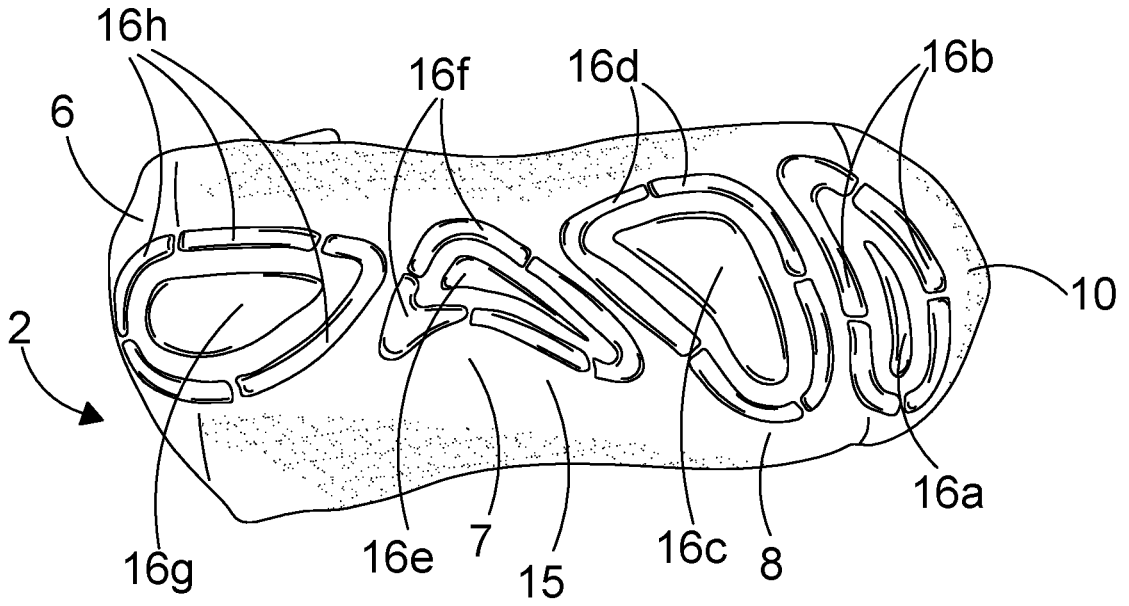
FIG. 5 is a top view of the sole of a knitted foot garment according to the present disclosure.
Figure 6:
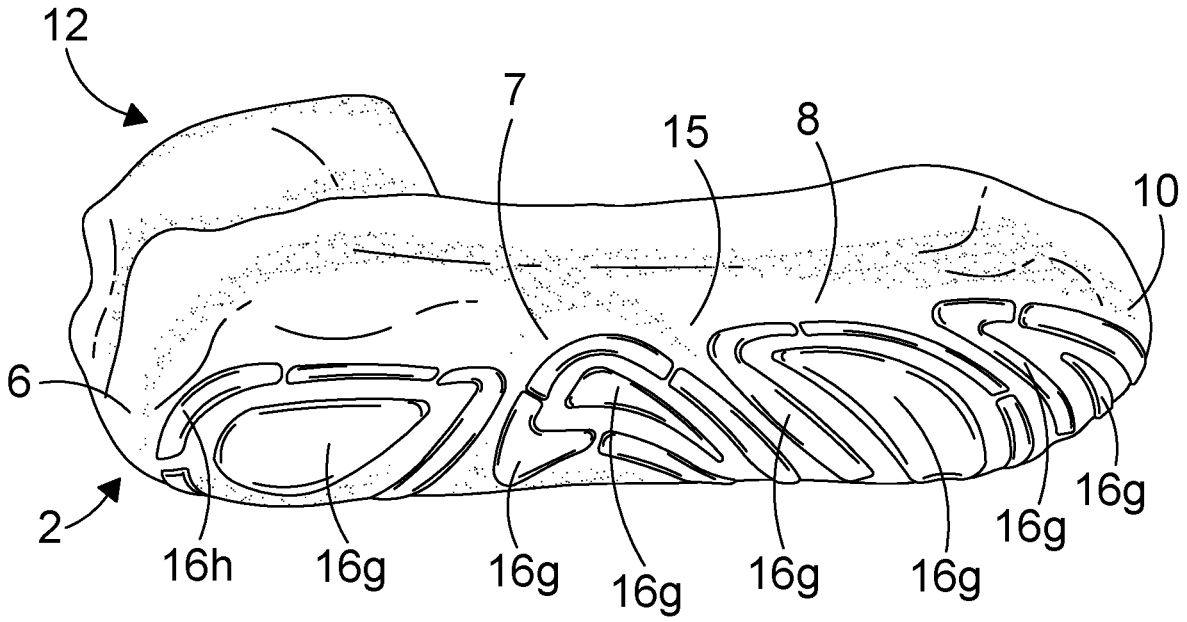
FIG. 6 is a top perspective view of the sole and upper of the knitted foot garment of FIG. 5.
Figure 7:
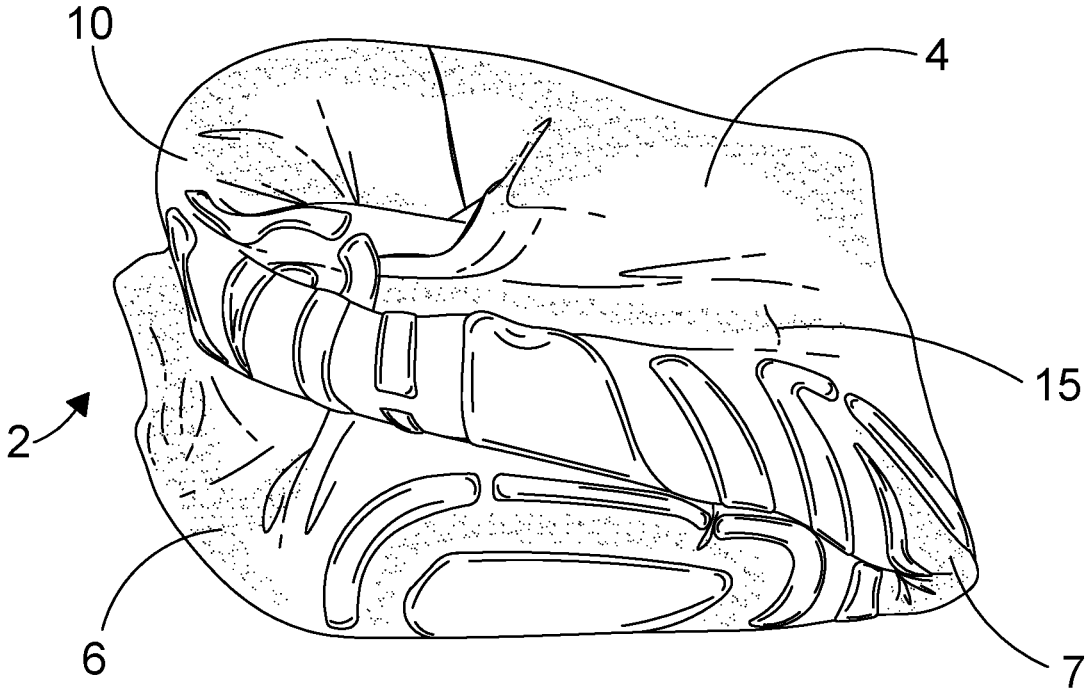
FIGS. 7 and 8 are perspective views of the knitted foot garment of FIGS. 5 and 6.
Figure 8:
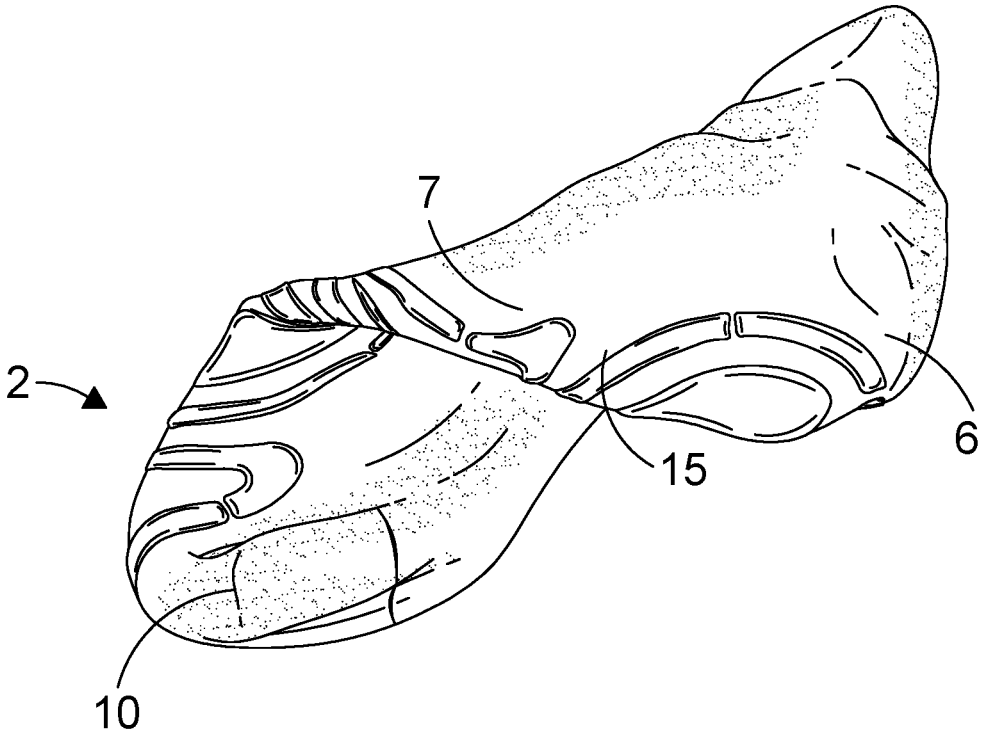

As shown in FIGS. 3 and 4, the silicone mixture 16 include a plurality of bubbles 18, which are formed by forcing gas into a hot silicone mixture, agitating the mixture to form the bubbles, and encapsulating the mixture within the template to trap the bubbles in the pads. The addition of bubbles to the mixture provides increased cushioning over the silicone alone.

It will be understood by those with skill in the art that other liquid polymers could be used in the place of silicone, and a range of gasses could be used to provide the bubbles. Further, the pads can be arranged in different configurations with more or less pads depending on the desired level of cushion on the sole of the garment.

Although the above description with reference to particular embodiments, it is to be understood that these embodiments are merely illustrative of the principles and applications of the present disclosure. It is therefore to be understood that numerous modifications may be made to the illustrative embodiments and that other arrangements may be devised and employed without departing from the spirit and scope of the present disclosure.

What is claimed is:

1. A knitted foot garment, comprising:

(a) upper, heel, arch, ball and toe knitted fabric portions integrally woven to define a chamber, said upper containing an opening configured to receive a foot;

(b) a plurality of encapsulated toe portion polymer pads containing gel having gas infused bubbles being attached to the knitted foot garment toe portion and generally configured to correspond with the contours of the toes of a foot, said plurality of toe portion polymer pads including a first inner pad and a second set of elongated outer pads arranged around the inner pad, an elongated gap between said toe portion first inner pad and said toe portion second set of elongated outer pads;

(c) a plurality of encapsulated ball portion polymer pads containing gel having gas infused bubbles being attached to the knitted foot garment ball portion and generally configured to correspond with the contours of the balls of a foot, said plurality of ball portion polymer pads including a first inner pad and a second set of elongated outer pads arranged around the inner pad, said ball portion first inner pad comprising a shape that varies from a shape of at least one pad of said ball portion second set of elongated outer pads;

(d) a plurality of encapsulated arch portion polymer pads containing gel having gas infused bubbles being attached to the knitted foot garment arch portion and generally configured to correspond with the contours of the arch of a foot, said plurality of arch portion polymer pads including a first inner pad and a second set of elongated outer pads arranged around the inner pad; and (e) a plurality of encapsulated heel portion polymer pads containing gel having gas infused bubbles being attached to the knitted foot garment heel portion and generally configured to correspond with the contours of the heel of a foot, said plurality of heel portion polymer pads including a first inner pad and a second set of elongated outer pads arranged around the inner pad.

2. The knitted foot gal lent of claim 1, wherein said toe portion first inner pad comprises a shape that varies from a shape of at least one pad of said toe portion second set of elongated outer pads.

3. The knitted foot gaiinent of claim 2, wherein said arch portion first inner pad comprises a shape that varies from a shape of at least pad one of said arch portion second set of elongated outer pads.

4. The knitted foot gaiinent of claim 3, wherein said heel portion first inner pad comprises a shape that varies from a shape of at least one pad of said heel portion second set of elongated outer pads.

5. A knitted foot gal lent, consisting of:

(a) upper, heel, arch, ball and toe knitted fabric portions integrally woven to define a chamber, said upper containing an opening configured to receive a foot;

(b) a plurality of encapsulated toe portion polymer pads containing gel having gas infused bubbles being attached to the knitted foot garment toe portion and generally configured to correspond with the contours of the toes of a foot, said plurality of toe portion polymer pads including a first inner pad and a second set of elongated outer pads arranged around the inner pad, an elongated gap between said toe portion first inner pad and said toe portion second set of elongated outer pads;

(c) a plurality of encapsulated ball portion polymer pads containing gel having gas infused bubbles being attached to the knitted foot garment ball portion and generally configured to correspond with the contours of the balls of a foot, said plurality of ball portion polymer pads including a first inner pad and a second set of elongated outer pads arranged around the inner pad;

(d) a plurality of encapsulated arch portion polymer pads containing gel having gas infused bubbles being attached to the knitted foot garment arch portion and generally configured to correspond with the contours of the arch of a foot, said plurality of arch portion polymer pads including a first inner pad and a second set of elongated outer pads arranged around the inner pad; and (e) a plurality of encapsulated heel portion polymer pads containing gel having gas infused bubbles being attached to the knitted foot garment heel portion and generally configured to correspond with the contours of the heel of a foot, said plurality of heel portion polymer pads including a first inner pad and a second set of elongated outer pads arranged around the inner pad.

6. The knitted foot gait lent of claim 5, wherein said toe portion first inner pad comprises a shape that varies from a shape of at least one pad of said toe portion second set of elongated outer pads.

7. The knitted foot garment of claim 6, wherein said ball portion first inner pad comprises a shape that varies from a shape of at least one pad of said ball portion second set of elongated outer pads.

8. The knitted foot garment of claim 7, wherein said arch portion first inner pad comprises a shape that varies from a shape of at least one pad of said arch portion second set of elongated outer pads.

9. The knitted foot garment of claim 8, wherein said heel portion first inner pad comprises a shape that varies from a shape of at least one pad of said heel portion second set of elongated outer pads.

* * * * *